US006274099B1

(12) United States Patent
Maus et al.

(10) Patent No.: US 6,274,099 B1
(45) **Date of Patent: *Aug. 14, 2001**

(54) DEVICE FOR CATALYTIC CONVERSION OF EXHAUST GASES IN AN EXHAUST SYSTEM AND PROCESS FOR MANUFACTURING SUCH A DEVICE

(75) Inventors: Wolfgang Maus; Rolf Brück, both of Bergisch Gladbach (DE)

(73) Assignee: Emitec Gesellschaft fuer Emissionstechnologies mbH, Lohmar (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/843,804

(22) Filed: Apr. 21, 1997

Related U.S. Application Data

(63) Continuation of application No. PCT/EP95/04027, filed on Oct. 12, 1995.

(30) Foreign Application Priority Data

Oct. 21, 1994 (DE) ..... 44 37 718

(51) Int. Cl.[7] ..... B01D 53/34; B01D 53/84; B01D 53/94

(52) U.S. Cl. ..... 422/180; 422/177; 422/179

(58) Field of Search ..... 422/171, 179, 422/177, 180, 174, 220, 199; 60/299, 300; 55/DIG. 30, 523; 502/439, 527.19, 527.2, 527.21, 527.22, 527.23

(56) References Cited

U.S. PATENT DOCUMENTS

| | | | | |
|---|---|---|---|---|
| 3,801,289 | * | 4/1974 | Wiley | 422/179 |
| 3,904,551 | * | 9/1975 | Lundsager et al. | 423/213.5 |
| 3,938,959 | | 2/1976 | Matsui et al. | 422/179 |
| 4,396,664 | * | 8/1983 | Mochida et al. | 422/180 |
| 5,051,241 | * | 9/1991 | Pfefferle | 422/180 |
| 5,219,667 | * | 6/1993 | Hampton | 502/439 |
| 5,413,767 | * | 5/1995 | Breuer et al. | 422/174 |
| 5,724,735 | * | 3/1998 | Ickes et al. | 422/171 |

FOREIGN PATENT DOCUMENTS

| | | |
|---|---|---|
| 2312794 | 9/1974 | (DE) . |
| 2444793 | 7/1980 | (FR) . |

* cited by examiner

*Primary Examiner*—Hien Tran
(74) *Attorney, Agent, or Firm*—Herbert L. Lerner; Laurence A. Greenberg; Werner H. Stemer

(57) ABSTRACT

In a device for the catalytic conversion of exhaust gases in an exhaust system, in particular an exhaust system of a combustion engine, and a process for manufacturing the same, a catalyst carrier body is provided with a multiplicity of channels through which an exhaust gas can flow. At least a part of a free flow cross-section of the channels is closed in an exhaust gas flow direction by plastic deformation of channel walls in an outer annular region of the catalyst carrier body. The plastic deformation can be carried out with a tool. The tool has a disk rotatable about an axle. The disk is pressed with force against the catalyst carrier body and the jacket so that a plastic deformation of the jacket tube and the channel walls occurs. A circumferential bead directed towards the carrier body is produced. Other techniques for plastic deformation are possible. The thus closed outer channels form a heat insulation with respect to the jacket tube, so that the catalyst carrier body heats up more quickly in a cold-starting phase.

3 Claims, 3 Drawing Sheets

DEVICE FOR CATALYTIC CONVERSION OF EXHAUST GASES IN AN EXHAUST SYSTEM AND PROCESS FOR MANUFACTURING SUCH A DEVICE

CROSS-REFERENCE TO RELATED APPLICATION

This application is a Continuation of International Application Ser. No. PCT/EP95/04027, filed Oct. 12, 1995.

BACKGROUND OF THE INVENTION

Field of the Invention

The invention relates to a device for the catalytic conversion of exhaust gases in an exhaust system, in particular in an exhaust system of a combustion engine, including a catalyst carrier body having a multiplicity of channels through which an exhaust gas can flow. The invention also relates to a process for manufacturing such a device.

In order to attain conversion of hydrocarbons and carbon monoxide contained in a combustion engine which is as complete as possible, the catalytic converter must be at a minimum temperature at which the catalytic conversion of components of the exhaust gas can take place. In general, that temperature is described as a so-called initiation temperature. The catalyst is heated during a cold starting phase by hot exhaust gas. It is also known to at least partially electrically heat the catalyst carrier body. In order to ensure that the output of pollutants is as low as possible during the cold starting phase, and for mechanical reasons, it has been proposed that the catalyst carrier body be constructed with an internal insulation in order to reduce heat loss to a housing and into the surroundings.

A device for catalytic conversion of exhaust gases in an exhaust system, in particular in an exhaust system of combustion engines, is known from German Published, Non-Prosecuted Patent Application DE 36 02 134 A1. That device is provided with a metallic catalyst carrier body disposed in a housing. The carrier body is provided with a large number of channels through which an exhaust gas can flow. The internal insulation of the catalyst carrier body is created according to German Published, Non-Prosecuted Patent Application DE 36 02 134 A1 in such a way that a radially inward facing collar is disposed in front of the catalyst carrier body. The height of the collar is 3–15% of the diameter of the catalytic converter, but at least 1 mm. A zone of eddy current is produced in the exhaust gas flow through the use of that collar and in that way direct contact of the hot exhaust gas with an outer annular region is avoided.

A device for the catalytic conversion of exhaust gases in an exhaust system is known from German Utility Model DE G 87 12 267.7 U1. The device includes a catalyst carrier body which is provided with a large number of flow channels for an exhaust gas and which is fitted into a sleeve-like housing. The housing is thermally insulated with respect to the catalyst carrier body. The insulation is obtained by placing the catalyst carrier body between end rings which close at least an outer layer of a metallic matrix body and thereby the outer flow channels in the matrix. In that way the outer region of the catalyst carrier body is provided with a closed air gap, through which exhaust gas does not flow and which serves as heat insulation.

SUMMARY OF THE INVENTION

It is accordingly an object of the invention to provide a device for catalytic conversion of exhaust gases in an exhaust system and a process for manufacturing such a device, which overcome the hereinafore-mentioned disadvantages of the heretofore-known devices and processes of this general type and in which the manufacture of a catalyst carrier body with an internal insulation is simplified.

With the foregoing and other objects in view there is provided, in accordance with the invention, a device for catalytic conversion of exhaust gases in an exhaust system, in particular in an exhaust system of combustion engines, comprising a catalyst carrier body having an outer annular region and having channel walls defining a multiplicity of channels with free flow cross-sections through which an exhaust gas can flow in a given direction, at least a part of the free flow cross-sections of the channels being closed in the given direction in the outer annular region by plastic deformation of the channel walls.

In contrast to the known devices for catalytic conversion of exhaust gases, an air gap enclosed in an outer region of the catalyst carrier body is not created by additional rings or the like, but instead the free flow cross-section of the channels is closed in part, that is to say in at least an axial part, by plastic deformation of the channel walls in the direction of flow of the exhaust gas. In this way the manufacture of the device is simplified, since a collar or end ring no longer has to be fitted in the housing. If the catalyst carrier body is composed of several wound layers of sheet metal, the plastic deformation can already be carried out during winding. This simplifies the manufacturing process for wound catalytic converters, since the winding procedure and the plastic deformation can take place at the same time.

In accordance with another feature of the invention, the channels are closed in the vicinity of a waste gas inlet. The plastic deformation of the channels is advantageously carried out prior to the application of a catalytically active layer on the catalyst carrier body. The coating (wash coat) is usually applied through the use of a suspension flowing through the catalyst carrier body. The catalyst carrier body can be disposed in such a way that the suspension flows into the channels which are closed on one side. The wash coat then fills up the channels. It forms a thermal insulation. If the catalyst carrier body is disposed in such a way that the closed channels are in the region where the suspension enters the catalyst body, the channels cannot be filled with the suspension. This improves the insulation since the heat conductivity of the catalyst carrier layer which completely fills up the channel is better than that of the atmosphere in the channels.

In accordance with a further feature of the invention, the channels are closed in the vicinity of the exhaust gas intake and outlet. If the plastic deformation does not completely close individual channels, this is compensated for by the subsequent coating, which closes small gaps.

In accordance with an added feature of the invention, the channels in the catalyst carrier body are configured in layers on top of one another, and up to five layers of the channels, preferably two, are closed. In this way an advantageous compromise between the necessity of having catalytically active surfaces and of heat insulation is obtained, without the external dimensions of the catalyst carrier body having to be substantially enlarged.

With the objects of the invention in view there is also provided a process for manufacturing a device for catalytic conversion of exhaust gases in an exhaust system, in particular in an exhaust system of combustion engines, which comprises dividing a catalyst carrier body into a multiplicity of channels having free flow cross-sections through which an exhaust gas can flow in a given flow direction; and plastically deforming the channels in an outer annular region of the catalyst carrier body for closing at least a part of the free flow cross-sections in the given direction.

In accordance with another mode of the invention, the plastic deformation is carried out in such a way that the catalyst carrier body is compressed in a die. When the catalytic converter carrier body is compressed, the outer region of the carrier body is deformed, so that the channels are closed.

In accordance with a further mode of the invention, the compression die is provided with a conical or annular wall.

In accordance with an added mode of the invention, instead of compressing the catalyst carrier body in a die, the plastic deformation of the channel walls is carried out in such a way that a force is exerted upon an outer annular region through the use of a stamp, which results in plastic deformation of the channel walls.

In accordance with an additional mode of the invention, the tamp is annular or has a wall sloping from the inside to the outside. If the stamp is provided with a wall sloping from the inside to the outside, the free flow cross-section of the channels can be closed by bending the channel walls. With an annular stamp, the channel walls are crushed.

In accordance with yet another mode of the invention, during the plastic deformation the catalyst carrier body is restrained by its end opposite to where the force is being applied. This has the advantage that the individual layers of the catalytic converter carrier body are not displaced with respect to one another.

Catalytic converter carrier bodies are known which are composed of a multiplicity of alternately structured and preferably smooth layers of sheet metal. Such metallic catalytic converter carrier bodies are surrounded by a jacket tube.

With the objects of the invention in view there is additionally provided a process for manufacturing a device for catalytic conversion of exhaust gases in an exhaust system, in particular in an exhaust system of a combustion engine, which comprises dividing a catalyst carrier body into a multiplicity of channels having free flow cross-sections through which an exhaust gas can flow in a given direction; surrounding the catalyst carrier body with a jacket tube; and plastically deforming the jacket tube and the channels in an outer annular region of the catalyst carrier body for closing at least a part of the free flow cross-sections in the given direction.

In accordance with another mode of the invention, the plastic deformation of the jacket tube and of the channels is carried out in such a way that at least one circumferential bead, directed towards the interior, is formed in the jacket tube. The bead can also be used for joining the catalyst carrier body to a housing.

In accordance with a concomitant mode of the invention, the plastic deformation is carried out through the use of free forming, rolling or working.

Other features which are considered as characteristic for the invention are set forth in the appended claims.

Although the invention is illustrated and described herein as embodied in a device for catalytic conversion of exhaust gases in an exhaust system and a process for manufacturing such a device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
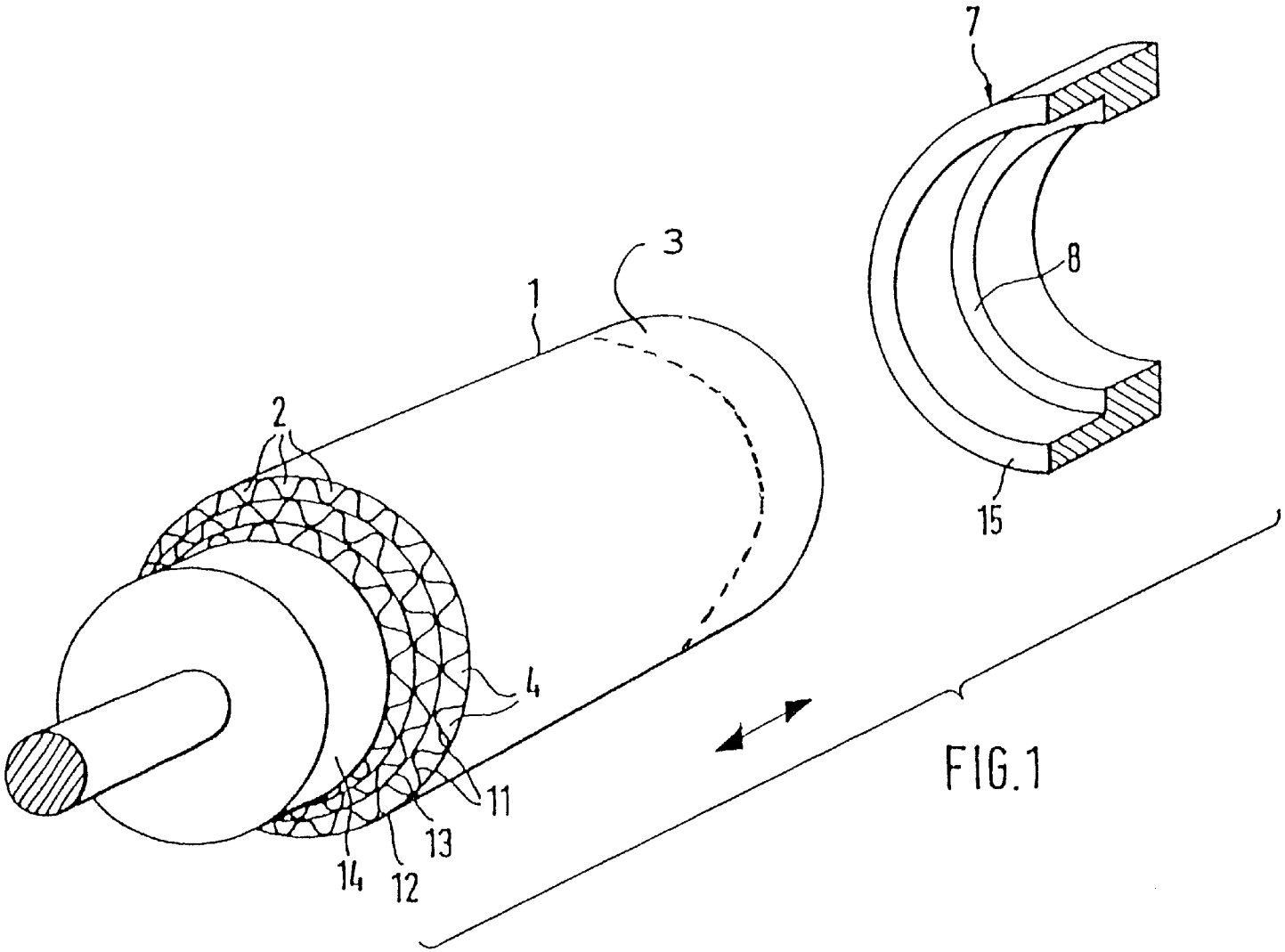
FIG. 1 is a diagrammatic, partly-sectional, perspective view of a catalyst carrier body and a first embodiment of a die.

Referring now to the figures of the drawings in detail and first, particularly, to FIG. 1 thereof, there is seen a catalyst carrier body 1 that is provided with a multiplicity of channels 2 through which an exhaust gas can flow from a waste gas inlet to a waste gas outlet defined by ends of the body. The channels 2 are constructed through the use of an alternating configuration of structured sheet metal layers 12 and smooth sheet metal layers 13. Each channel is provided with a free flow cross-section 4, which is delimited by channel walls 11. The channel walls are formed by the layers 12, 13 of sheet metal. In order to provide plastic deformation in an outer annular region 3 of the catalytic converter carrier body 1, the carrier body is compressed in a die 7 shown in FIG. 1. For this purpose, the catalyst carrier body 1 can be held, for example through the use of clamps which are not shown, and correspondingly compressed in the die 7. In the illustration according to FIG. 1, the honeycomb body 1 is compressed in the die 7 through the use of a tool 14. An annular wall 8 is configured in the first embodiment of the die 7 shown in FIG. 1. The width of the annular wall 8 corresponds to the width of channels to be closed in the honeycomb body 1. A jacket 15 which has inner contours that correspond to outer contours of the catalyst carrier body 1, is connected to the wall 8.

Figure 2:
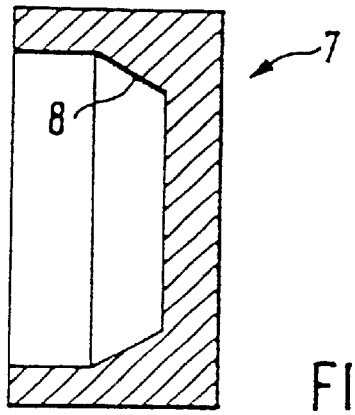
FIG. 2 is a sectional view of a second embodiment of a die.

FIG. 2 shows a second embodiment of a die 7. The die 7 has a wall 8 which is conically configured.

Figure 3:
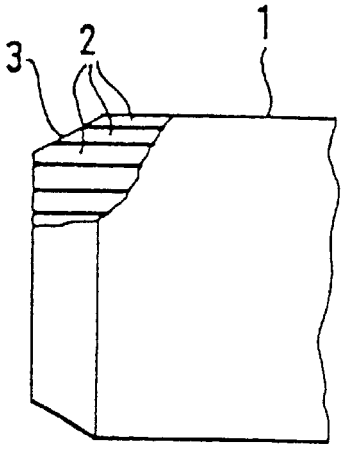
FIG. 3 is a fragmentary, perspective view of a carrier body compressed in a die according to FIG. 2.

FIG. 3 shows a honeycomb body 1, which is compressed in a corresponding die 7 according to FIG. 2. The channels 2 are closed in the annular region 3. An edge region of the carrier body is correspondingly configured at an angle.

Figure 4:
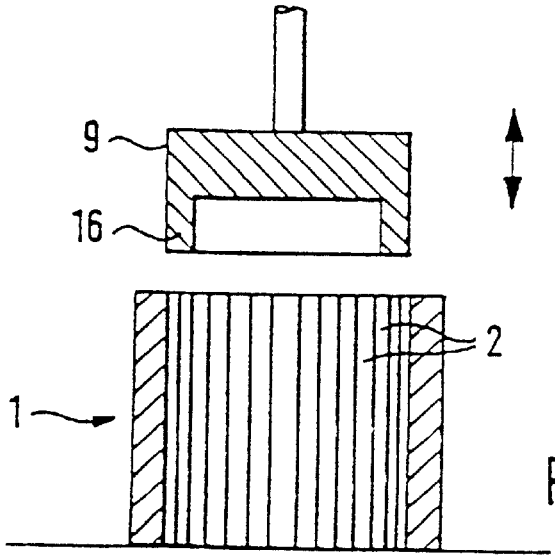
FIG. 4 is a cross-sectional view of a catalyst carrier body and a first embodiment of a stamp.
Figure 5:
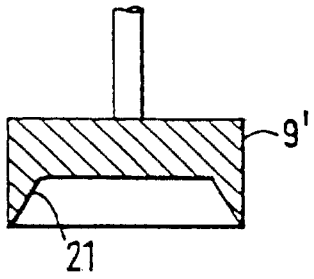
FIG. 5 is a cross-sectional view of a second embodiment of a stamp.

Instead of compressing the carrier body 1 in a die 7, the channels 2 may be closed by plastic deformation through the use of a stamp 9 or 9' shown in FIGS. 4 and 5. The stamp 9 or 9' can be moved backwards and forwards and is provided with an annular projection 16.

The stamp 9' differs from the stamp 9 in that it is provided with a wall 21 sloping from the inside to the outside.

Figure 6:
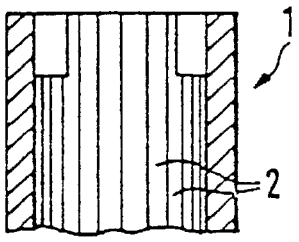
FIG. 6 is a fragmentary, cross-sectional view of a plastically deformed carrier body according to FIG. 4.
Figure 7:
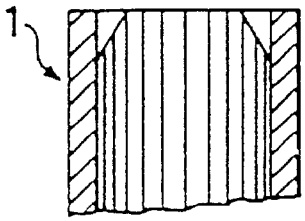
FIG. 7 is a fragmentary, cross-sectional view of a carrier body plastically deformed by deformation with a stamp according to FIG. 5.

Carrier bodies 1 are shown in FIGS. 6 and 7. In the carrier body which is shown in cross-section in FIG. 6, the channels 2 have been closed in the outer annular region through the use of the stamp 9. FIG. 7 shows a carrier body in which the stamp 9' according to FIG. 5 has been used.

Figure 8:
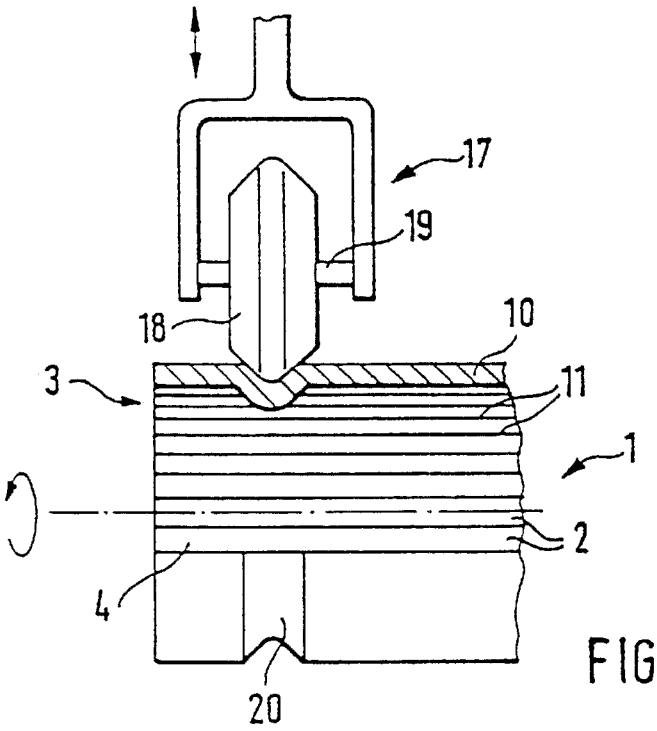
FIG. 8 is a fragmentary, partially-sectional view of a carrier body.

FIG. 8 illustrates the manufacture of a device for catalytic conversion of exhaust gases in an exhaust system, in particular in an exhaust system for combustion engines. In this configuration, a catalyst carrier body 1 is surrounded by a jacket tube 10 and is provided with a large number of channels 2. The catalyst carrier body can be manufactured in such a way that a plastic deformation of the jacket tube 10 and of the channels 2 is carried out in an outer annular region 3, so that a free flow cross-section 4 of the channels 2 is partially closed in the direction of flow of the exhaust gas. The plastic deformation can take place through the use of a tool 17. The tool 17 is provided with a disk 18, which has a substantially triangular cross-section on its outer edge area and is rotatable about an axle 19. The disk 18 is pressed with force against the catalyst carrier body 1 and the jacket 10, so that a plastic deformation of the jacket tube 10 and the channel walls occurs. A bead 20 is produced circumferentially with respect to the carrier body 1.

The tool 17 can rotate about the catalyst carrier body 1. It is also possible to dispose the tool 17 in a stationary manner and to allow the catalyst carrier body 1 to rotate about its axis.

The configuration of the bead 20 can be in steps, in which case the tool 17 is advanced correspondingly.

We claim:

1. A device for catalytic conversion of exhaust gases in an exhaust system, comprising:

a housing containing a catalyst carrier body formed of wound layers of sheet metal and having an exhaust gas inlet region, an exhaust gas outlet region, an outer annular region, an inner region and channel walls defining a multiplicity of channels with free flow cross-sections through which an exhaust gas can flow in a given direction;

said channel walls in said outer annular region and said housing being deformed together by a plastic deformation while said channel walls are in said housing, thereby, effecting a superior positioning and fixation of said catalyst carrier body within said housing without a need for a collar or end rings, said channels in said outer annular region being completely closed in the vicinity of said exhaust gas inlet region and in the vicinity of said exhaust gas outlet region by one of the plastic deformation and coating material, said completely closed channels forming a thermally insulating region due to an atmosphere in said completely closed channels.

2. The device according to claim 1, wherein said channels are disposed on top of one another in layers, and said channels are plastically deformed in up to five of said layers.

3. The device according to claim 1, wherein said channels are disposed on top of one another in layers, and said channels are plastically deformed in two of said layers.

* * * * *